United States Patent [19]

Kemble et al.

[11] Patent Number: 4,595,225

[45] Date of Patent: Jun. 17, 1986

[54] METHOD AND APPARATUS FOR LIFTING INGOT MOLDS AND LIKE OBJECTS

[76] Inventors: Mern S. Kemble, 130 Entrance Way, New Kensington, Pa. 15068; Matthew Mancusso, 833 Second Ave., Verona, Pa. 15147

[21] Appl. No.: 568,819

[22] Filed: Jan. 6, 1984

[51] Int. Cl.[4] ..... B66C 1/42

[52] U.S. Cl. ..... 294/86.41; 294/88

[58] Field of Search ..... 294/86 LS, 65.5, 78 A, 294/103 CG, 88; 414/658, 744 C, 737

[56] References Cited

U.S. PATENT DOCUMENTS 2,213,014 8/1940 Owen ..... 294/88

3,075,664 1/1963 Collings ..... 294/86 LS

*Primary Examiner*—James B. Marbert

*Attorney, Agent, or Firm*—Jon M. Lewis

[57] ABSTRACT

A novel tong which may be activated or deactivated electromagnetically is used to advantageously reposition ingot molds or the like. Chain-like positioning means are used to position the tong. Cables are used to carry the load of the molds.

3 Claims, 3 Drawing Figures

METHOD AND APPARATUS FOR LIFTING INGOT MOLDS AND LIKE OBJECTS

BACKGROUND OF THE INVENTION

Field of Invention

This invention generally pertains to a method and apparatus for lifting and repositioning at least partially hollow objects such as ingot molds and like objects. Oftentimes, it is necessary or advantageous to move upright objects and then to reposition the object on its side. This invention is especially suited to perform repositioning tasks of this nature.

In the case of ingot molds, cleaning has been accomplished while the mold is in an upright position with use of chain flails which travel in a vertical fashion. Cleaning is performed for the purpose of improving the surface quality of the steel ingots which are cast in the molds. Upon use and exposure of the temperatures of molten steel the interior mold surfaces become subject to heat checking. Heat checking is manifested in a series of small cracks and fissures which then lead to a deterioration of ingot surface quality upon casting of the ingot. The purpose of ingot cleaning, thus, is to minimize these cracks as well as provide a clean surface for the casting process. One of the advantages of this invention is that the ingot molds may be easily placed on a longitudinal position to facilitate cleaning. The molds may then be advantageously cleaned in the manner set forth in copending application U.S. Pat. No. 4,407,037, filed on Aug. 25, 1981, and entitled "MOLD CLEANING APPARATUS".

Inasmuch as the mold is placed on its side, air can more easily pass through the open mold, thereby considerably improving cooling time of the mold. Moreover, ease of cleaning of the mold bottom is enhanced and visibility for inspection or other purposes is greatly facilitated.

The repositioning advantage is obtained with use of the method and apparatus of the invention because the invention is especially adapted to lift and reposition ingot molds and like shaped objects. Others in the prior art have designed lifting devices to move such objects. Examples of these devices include U.S. Pat. Nos. 2,925,300; 2,945,609; 3,190,685; 3,333,883; and 3,436,116. Although these patents involve grapples which engage one side and the central opening of the object being lifted, none of the patents are believed to teach the highly advantageous combination of advantages possessed by this invention. Such advantages and improvements to the art will become more apparent to those skilled in the art from the following description of the invention.

SUMMARY OF THE INVENTION

In its apparatus form, the invention includes lifting tongs comprising a generally L-shaped housing member; a first grappling member fixedly connected to the housing member; a second grappling means movably connected to the housing member and positioned generally parallel to the first grappling member; electromagnetic activation means for causing the second grappling member to lock and unlock and positioning means for causing the secured member to move in a direction away from the housing member and toward the first grappling member so as to be able to grasp an at least partially hollow object to be secured by the first and second grappling members, the activation means is located proximate to the second grappling member, and are also able to assist the second grappling member to move in a direction away from the first grappling member so as to become attached to the housing members and thereby be able to release the grasped object. Included are positioning means connected to the housing member at end portions of the housing member for causing a rotational change of position of the tong and means connected to the housing member for lifting and lowering the tong. The weight of the apparatus is borne by lifting means such as cables.

In its method form, the invention comprises a technique for lifting an at least partially hollow object having a vertical axis and then repositioning the object to a desired amount away from said vertical axis.

The method generally comprises the use of the apparatus described above to lift and reposition objects such as ingot molds and the like. The method first comprises lowering the lifting tong of the invention, while in the activated or locked condition, until the tong is positioned with the first grappling member located inside of a central opening in the object and the second grappling member located at a position exterior of the object. The electromagnetic device is then deactivated by turning off the electric current that activates the device. This procedure permits the second grappling member to be unlocked or released from contact with the housing member and then caused to become in contact with the exterior surface of the object due to tension applied by the roller chain or like means attached to the housing member at the end portion of the housing member that is closest to the first grappling member, thereby causing both grappling members to firmly grasp the object. The grasped object is then lifted with use of the lifting means. The grasped object is then rotated about its vertical axis in a desired amount through applications of tension, actually by shortening the chain, to the chain means located at the end of the housing member located most proximate to the second grappling member. The grasped object is then placed at a desired position. The lifting tong is then pulled from the object and, upon release, the weight is removed from the roller chain and the second grappling member thus resumes its original position and the electromagnetic means is then locked or activated by switching on the electric current and the second grappling member is then pulled into contact and locked with the housing member.

DETAILED DESCRIPTION OF THE INVENTION

Figure 1:
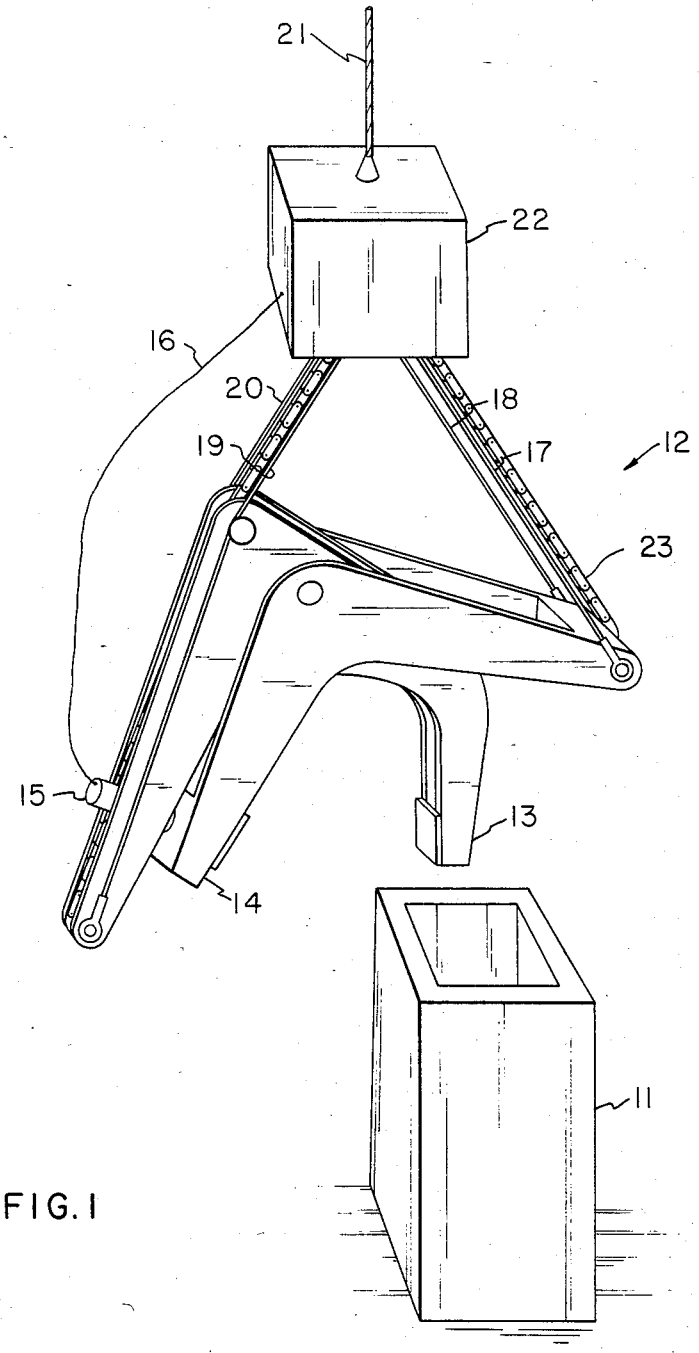
FIG. 1 depicts the tong apparatus of the invention positioned over an ingot mold prior to being moved into position to grasp and lift such mold.

The working and principles of the invention can be best further illustrated through reference to the drawings. FIG. 1 illustrates the tong in the activated position prior to being lowered to grasp ingot mold 11. The tong comprises L-shaped housing member 12, first grappling member 13, second grappling member 14, electromagnetic device (an electromagnet) 15, electrical power connection 16, cables 17 and 18 which are connected to the end of housing member 12 most proximate to first grappling member 13, lifting cables 19 and 20 which are connected to the end of housing member 12 most proximate to second grappling member 14, and lifting and lowering chain 21. Roller chain 23 is used to position the tongs. As may be observed the length of the roller chain 23, the preferred type of positioning means, may be shortened or lengthened through adjustment in tension through a reel located in adjustment means 22. This adjustment device utilizes a conventional pulley and cable arrangement which is not shown in detail. It should also be noted that second grappling member 14 is pulled against housing 12 due to the magnetic force created by electromagnetic device 15. The tong is shown in the activated or locked position in this Figure.

Figure 2:
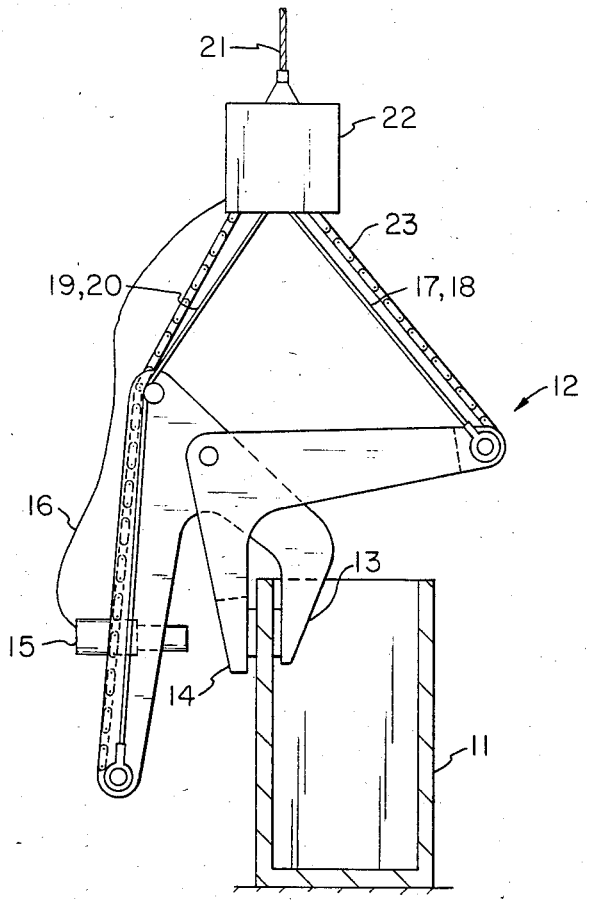
FIG. 2 depicts the tong apparatus after it has been lowered into position to grasp the mold and then secured into a locked position prior to lifting the mold.

FIG. 2 illustrates the tong being lowered into mold 11 and the device 15 being deactivated or unlocked by switching off the electric current. As may be seen deactivation permits second grasping member 14 to be urged against the exterior surface of mold 11 through application of tension by cables 12 and 18 at the end of housing member 12 nearest to first grappling member 13. Such tension causes grappling member 14 to rotate against the exterior of mold 11 and thereby cause a grasping action to occur.

Figure 3:
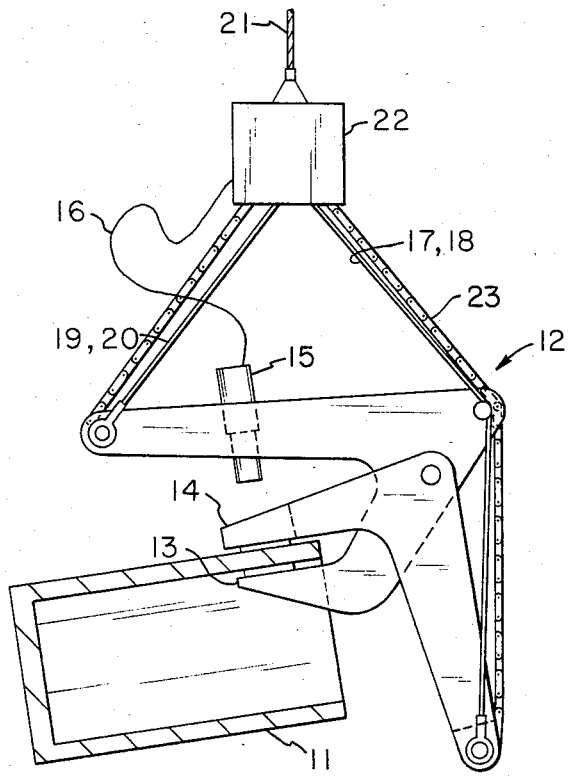
FIG. 3 depicts the tong apparatus and mold following adjustment in position to place the mold on its side.

FIG. 3 illustrates the rotational effect of shortening chain 23 through tension. This permits the grasped object to be repositioned at any desired angle from its original axis. For cleaning operations an angle of about 90 degrees is preferred so as to provide for improved access to the mold by the cleaning devices. This also permits easier removal of debris created by the cleaning operation.

The lifting and lowering means conveniently may comprise a chain, cable, or the like. The chain may be attached to a crane body, a straddle carrier or tracked vehicle or any other convenient device or object.

We claim:

1. A lifting tong, comprising:

a. a generally L-shaped housing member;

b. a first grappling member fixedly connected to said housing member;

c. a second grappling member movably connected to said housing member and positioned generally parallel to said first grappling member;

d. electromagnetic activation and deactivation means for causing said second grappling member to lock and unlock to said housing member and positioning means for causing said second member to move in a direction away from and toward said first grappling member and to become attached and detached to a portion of said housing so as to permit releasing and grasping of an at least partially hollow object by said first and second grappling members, said activation means being located proximate to said second grappling member;

e. positioning means connected to said housing member at both end portions of the housing member for causing a rotational change of position of said tong; and f. means connected to said housing member for lifting and lowering said tongs.

2. The lifting tong of claim 1, wherein:

said positioning means comprise a roller chain.

3. A method for lifting an at least partially hollow object having a vertical axis and then repositioning said object to a desired amount from said vertical axis, comprising:

a. lowering a lifting tong in the activated condition which comprises a generally L-shaped housing member; a first grappling member fixedly connected to said housing member; a second grappling member movably connected to said housing member and positioned generally parallel to said first grappling member; electromagnetic activation and deactivation means for causing said second grappling member to become locked and unlocked to a portion of said housing so as to permit releasing and grasping of an at least partially hollow object that is to be grasped by said first and second grappling members, said activation means being located proximate to said second grappling member; positioning means connected to said housing member at both end portions of the housing member for causing a rotational change of position of said tong; and means connected to said housing member for lifting and lowering said tong until said tong is positioned with said first grappling member inside of an opening of said object and said second grappling member located at a position exterior of said object;

b. then deactivating said electromagnetic means whereby said second grappling member is released from contact with said housing member and then caused to come into contact with an exterior surface of said object due to tension applied by said positioning means attached to said housing member at the end portion of said housing member that is closest to said first grappling member thereby causing said first and second grappling members to firmly grasp said object;

c. lifting said grasped object with use of said lifting means;

d. rotating said grasped object a desired amount by applying increased tension to said positioning means located at the end of the housing member located most proximate to said second grappling member;

e. placing said grasped object at a desired position;

f. activating said electromagnetic means whereby said second grappling member is pulled into contact with said housing member thereby releasing the grasped object; and g. removing said tong from said object.

* * * * *